US006023793A

United States Patent [19]

Baker

[11] Patent Number: 6,023,793

[45] Date of Patent: Feb. 15, 2000

[54] SWIMMING POOL GUTTER INCLUDING A WALL COVERING FASTENED THERETO

[76] Inventor: William H. Baker, 50 Fairway Ridge, Lake Wylie, S.C. 29710

[21] Appl. No.: 09/330,382

[22] Filed: Jun. 11, 1999

Related U.S. Application Data

[63] Continuation of application No. 08/739,246, Oct. 29, 1996, Pat. No. 5,978,979, which is a continuation of application No. 08/494,908, Jun. 26, 1995, abandoned.

[51] Int. Cl.[7] ..... E04H 4/14

[52] U.S. Cl. ..... 4/510; 4/506

[58] Field of Search ..... 4/506, 507, 510, 4/511, 512; 52/361, 362, 363, 390, 391

[56] References Cited

U.S. PATENT DOCUMENTS

| | | | |
|---|---|---|---|
| 1,807,630 | 6/1931 | McFarlin | 52/391 |
| 3,631,545 | 1/1972 | Orndorff | 4/510 X |
| 3,885,364 | 5/1975 | Lankheet | 52/169.7 |
| 4,007,566 | 2/1977 | Molitor | 4/510 X |
| 4,270,325 | 6/1981 | Mandelli | 52/391 |
| 4,621,001 | 11/1986 | Bard | 52/391 X |
| 4,985,007 | 1/1991 | Ellis | 4/496 X |
| 5,279,002 | 1/1994 | Ellis et al. | 4/510 |

FOREIGN PATENT DOCUMENTS

| | | | |
|---|---|---|---|
| 29 19200 A1 | 12/1979 | Germany . | |
| 1174063 | 12/1969 | United Kingdom | 4/510 |

*Primary Examiner*—Robert M Fetsuga
*Attorney, Agent, or Firm*—Kennedy Covington Lobdell & Hickman

[57] ABSTRACT

A perimeter skimming gutter for a swimming pool includes a gutter having a gutter wall preferably formed of sheet material and arranged for disposition toward the interior of the swimming pool. The gutter wall includes a fastener receiving member. A wall covering preferably including either a tile or vinyl surface facing is attachable with a fastener that extends through the wall covering to the gutter wall and is releasably received in mating relation by the fastener receiving member. The fastener thereby retains the wall covering in abutment with and in covering relation to the sheet material of the gutter wall.

8 Claims, 5 Drawing Sheets

SWIMMING POOL GUTTER INCLUDING A WALL COVERING FASTENED THERETO

This is a continuation patent application of application Ser. No. 08/739,246, filed Oct. 29, 1996, now U.S. Pat. No. 5,978,979, which is a continuation patent application of application Ser. No. 08/494,908, filed Jun. 26, 1995, abandoned Nov. 6, 1996.

BACKGROUND OF THE PRESENT INVENTION

U.S. Pat. No. 5,279,002, dated Jan. 18, 1994, to Ellis, et al, provides an inlaid tile gutter system for use in swimming pools that contains a channel, braces mounted atop the primary gravity flow channel, and stiffeners mounted on the poolside of the channel. This provides a relatively stiff gutter system capable of withstanding deformations due to excessive loading and impact. Ferro concrete material may be placed within channels formed by the vertical stiffeners to provide a support and a base upon which to set tile.

According to Ellis, et al, in the swimming pool industry it is often desirable to have a stainless steel perimeter gutter system which is capable of handling large amounts of water for filtration. One disadvantage with stainless steel gutter systems is that they have a very slippery stainless steel poolside surface. Consequently, it is difficult for swimmers to firmly support themselves along the inside pool wall.

Ellis, et al, notes that in pools used for competitive swimming, swimmers use the upper portion of the inside of the pool to turn when they reach the end of the pool during a race. Typically, the swimmer inverts his body 180° prior to touching the side of the pool, and then pushes off the side with the feet. Therefore, a non-slippery surface is preferable, so that the competing swimmers may get the optimum push off the pool wall to more efficiently transfer his or her momentum to the opposite direction.

Also, competitive swimming rules require backstroke swimmers to utilize the interior surface of the gutter for the start of their races. The backstroker must be in contact with the sidewall of the pool prior to the start of the race, and push off the upper inner side of the pool (i.e., the gutter) to begin the race. The more slippery the gutter wall is, the more difficult it is for the backstroker to get a quick start, thereby putting the backstroker at a competitive disadvantage.

Ellis further asserts that apart from competitive swimming, it is otherwise desirable to have a non-slippery inside upper wall portion in the swimming pool. For example, lifeguarding classes, swimming classes, children's swimming sessions, wading, etc., would be made easier with a non stainless steel perimeter. As a result, Ellis claims it is desirable to create a gutter system which is capable of supporting a non-slippery surface within the water. Because of its slipperiness and propensity for deformation, it is preferable to have a material other than stainless steel on the outer poolside surface of the gutter, while having stainless steel for the inner gutter lining. Tile is preferably used on upper walls in swimming pools not having perimeter stainless steel gutter systems because it is hard, non-slippery, and water resistant. Typically, it has not been possible to utilize tile on the outer walls of the stainless steel gutter systems. Stainless steel is not a surface upon which tile may be successfully applied because tile cements, glues, grouts and mortars do not bond well to stainless steel. Any attempt to glue or cement tile directly to the stainless steel gutter typically results in the tile falling off the gutter wall.

According to Ellis, another problem with conventional stainless steel gutter systems is that the stainless steel wall of the gutter will flex and deform, if the wall is subjected to a sufficient force. This problem is compounded with rolling bulkheads, which use the gutters of swimming pools as bearings to support the bulkhead weight. These bulkheads are long spans which cover the width of a pool to effectively divide a swimming pool into two more separate pools. The bulkheads are capable of rolling along the gutter system at different pool lengths to change the effective pool size. Because the weight of these bulkheads is supported by the gutter systems, the walls of the stainless steel gutters will deform due to stress placed on the gutters. The problem of bonding tile to stainless steel is, therefore, compounded by the problem of the gutter walls bending and deforming due to impacts and bulkhead loadings.

Ellis, therefore, designs an inlaid gutter system to overcome stress differentials. The gutter channel designed to receive pool overflow is defined by a back wall and a front wall protruding upwards from a lower surface; a plurality of braces mounted to the front wall and the channel; a plurality of stiffeners mounted on the outer side of the front wall of the channel; and a lower lip protruding from the outer side of the front wall for supporting a Ferro concrete material thereon.

The front wall of the channel may contain an outwardly protruding upper lip so that the upper lip, lower lip and front wall form a cavity for retaining Ferro concrete filling material. The Ferro concrete material may be placed within the cavity. The stiffeners may be effectively L-shaped and vertically mounted on the front wall of the channel so that each side of the stiffener and the front wall forms a vertically extending channel. The cavity formed by the front wall upper lip and lower lip is divided into a plurality of vertically extending channels. The Ferro concrete material used within the system may comprise a reinforcing means placed over a non-shrink gout. The reinforcing means may be a wire mesh. The vertical stiffeners may contain a plurality of holes therein.

The Ellis, et al, construction has a number of disadvantages. The tile face is permanently installed in the pool wall, and cannot be removed for repairs and regrouting without having to drain the pool; this cannot be done without taking the pool out of use. In addition, in the case of outdoor pools, the tile is subject to frost damage which is also difficult if not impossible to repair, requiring reconstruction to replace broken tile.

SUMMARY OF THE PRESENT INVENTION

In accordance with the present invention, these difficulties are overcome by providing a swimming pool wall covering that is readily removable from the gutter and therefore easily repaired or exchanged to provide another surface, even in winterizing the pool.

The perimeter skimming gutter of the present invention comprises a gutter having a gutter wall with a planar portion formed of sheet material and arranged for disposition toward an interior of the swimming pool. The gutter wall includes a fastener receiving member. A wall covering attaches to the gutter wall for covering of the planar portion. The wall covering includes a base and a facing surface affixed to the base. The base itself includes an opening extending between opposite sides thereof. A fastener extends through the opening in the base and is received in mating relation by the fastener receiving member. The fastener includes a portion engaging the base that urges the base toward the planar portion whereby the wall covering is retained in covering relation to the gutter wall.

In a feature of the present invention, the fastener receiving member is provided integral with and protrudes from the planar portion. In a preferred embodiment the fastener receiving member comprises a nut that is welded to the gutter wall. The nut provides a threaded bore for receipt of a fastener and, thus, the integrity of the planar portion of the gutter wall itself is preserved thereby avoiding the possibility of leaks developing in the gutter wall.

The present invention also encompasses a method for covering a planar portion of a gutter wall of a perimeter skimming gutter of a swimming pool with a wall covering that is readily removable and therefore easily repaired or replaced. The method includes the steps of: providing a fastener receiving member on a planar portion of the gutter wall with the fastener receiving member protruding from the planar portion of the gutter wall; inserting a fastener through the base of the wall covering and into mating relation with the fastener receiving member, the fastener including a portion engaging the base and urging the base toward the gutter wall and the facing surface into covering relation with the gutter wall; and, later, withdrawing the fastener from the fastener receiving member for removal of the wall covering for repair or replacement. Preferably, the fastener receiving member is provided by mounting it to the gutter wall by welding.

The invention further provides a swimming pool having such a wall covering removably attached to at least a portion of a perimeter gutter thereof.

In a preferred embodiment, the gutter is of stainless steel, and the facing surface carried on the base of the wall covering is ceramic tile.

BRIEF DESCRIPTION OF THE FIGURES

Exemplary embodiments of swimming pool perimeter gutters including on at least a portion of an interiorly-facing surface thereof a wall covering of the invention are shown in the drawings, in which.

DETAILED DESCRIPTION OF PREFERRED EMBODIMENTS

Figure 1:
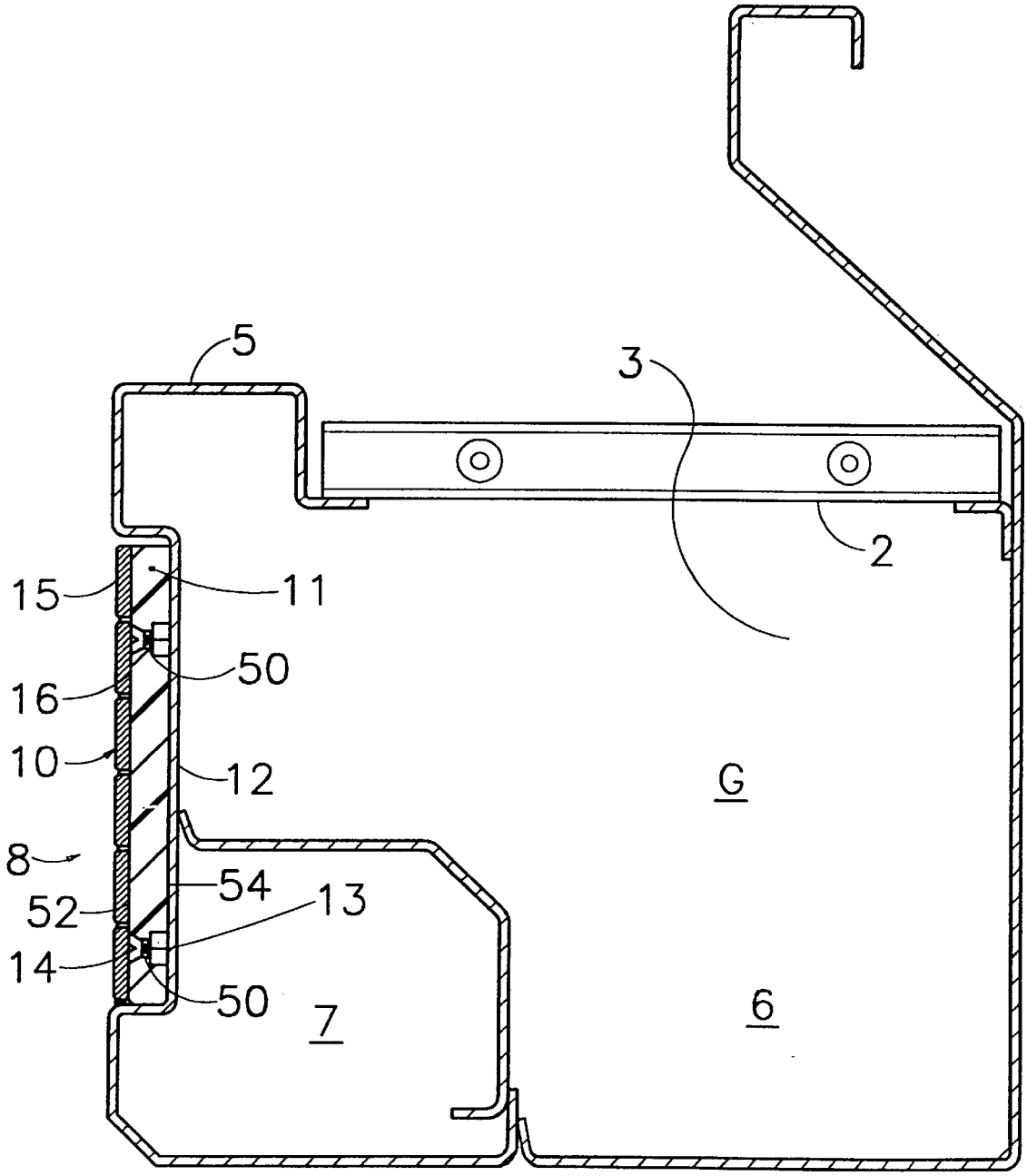
FIG. 1 shows a first type of perimeter skimming gutter incorporating a first preferred wall covering including a ceramic tile facing surface carried on the base thereof.

The perimeter skimming gutter G shown in FIG. 1 is made of stainless steel sheet 5 folded around to define a gutter channel 6 open at the top, with the opening 3 protected by the grating 2, collecting water flowing over the perimeter rim and feeding it in conventional fashion (not shown) for cleaning and return to the pool via return tube 7.

The interior face 10 of the gutter is provided by a wall covering 8 of the present invention. The wall covering 8 has a base 11 having openings 50 that extend between opposite sides 52,54 thereof. The base 11 is removably attached to the gutter wall 12 via fastener receiving members comprising nuts 13 that are attached to the gutter wall 12 and fasteners comprising bolts 14 that extend through the openings 50 and retain the base 11 against the gutter wall 12. In particular, the head of the bolt 14 includes a portion that engages the base 11 and urges the base 11 toward the gutter wall whereby the wall covering is retained in covering relation to the gutter wall. The base 11 carries the tile facing 15, adhered thereto by adhesive 16, and the tile can be removed from the base 11 by the usual tools for repair or replacement. This is best done by detaching the wall covering 8 from the gutter wall 12, whereupon it is accessible for work by the repairman. After the necessary work, the wall covering 8 is easily reattached.

Figure 2:
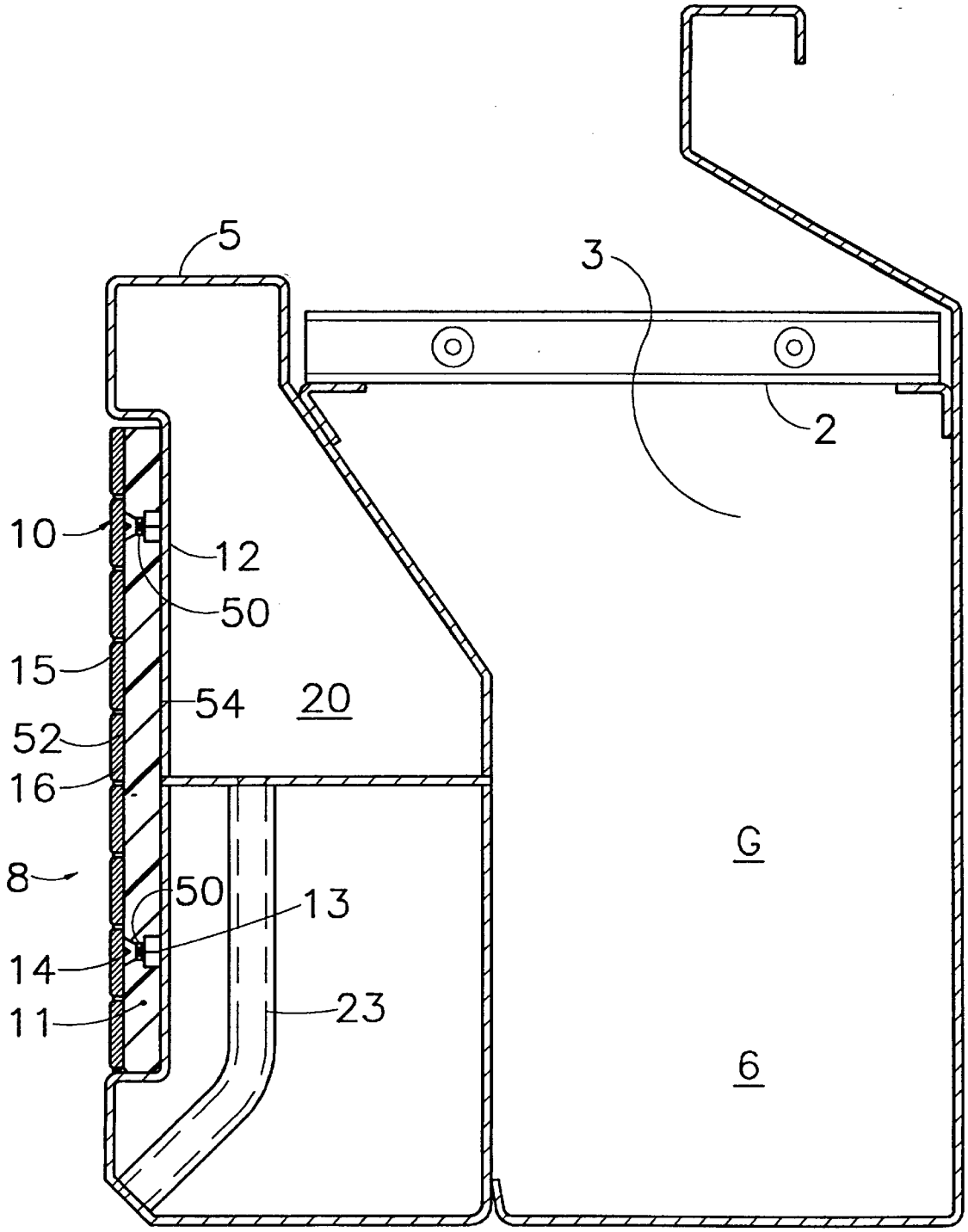
FIG. 2 shows another type of perimeter skimming gutter having a return water supply tube and incorporating the wall covering of FIG. 1.

The perimeter skimming gutter of FIG. 2 is similar to the perimeter skimming gutter of FIG. 1, and therefore like numbers are used for like parts.

The gutter G in this case includes a return water supply tube 20, connected to the pool via a plurality of inlet tubes 23, for return of cleaned water from the gutter to the pool.

Figure 3:
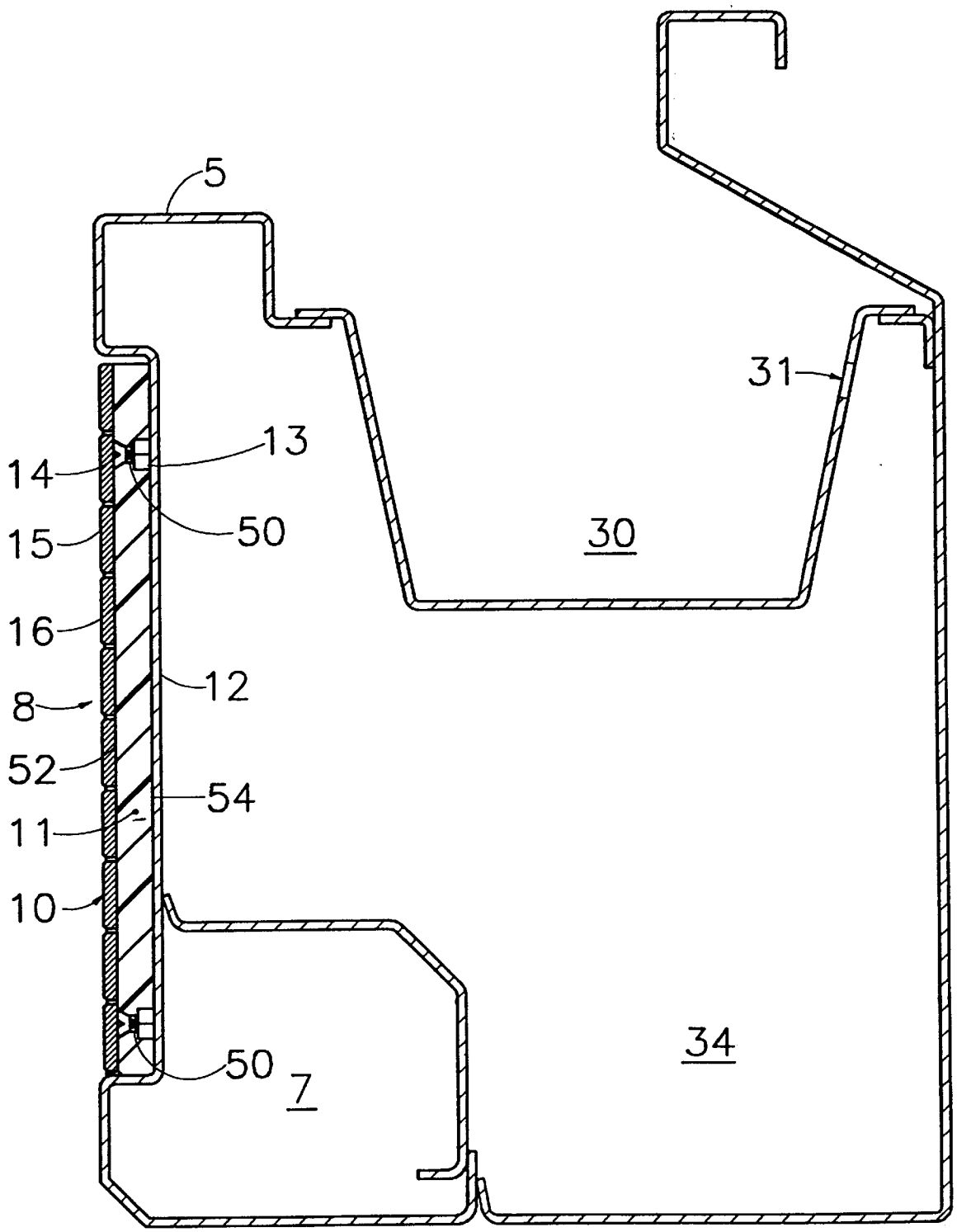
FIG. 3 shows yet another type of perimeter skimming gutter having two gutters for collecting overflow pool water and a return water supply tube, and incorporating the wall covering of FIG. 1.

The perimeter skimming gutter of FIG. 3 is similar to the perimeter skimming gutter of FIG. 1, and thus again like numbers are used for like parts.

The gutter in this case includes a removable upper channel 30 connected via overflow ports 31 to a second gutter channel 34 below and which accordingly comes into use only when channel 30's capacity is exceeded.

Figure 4:
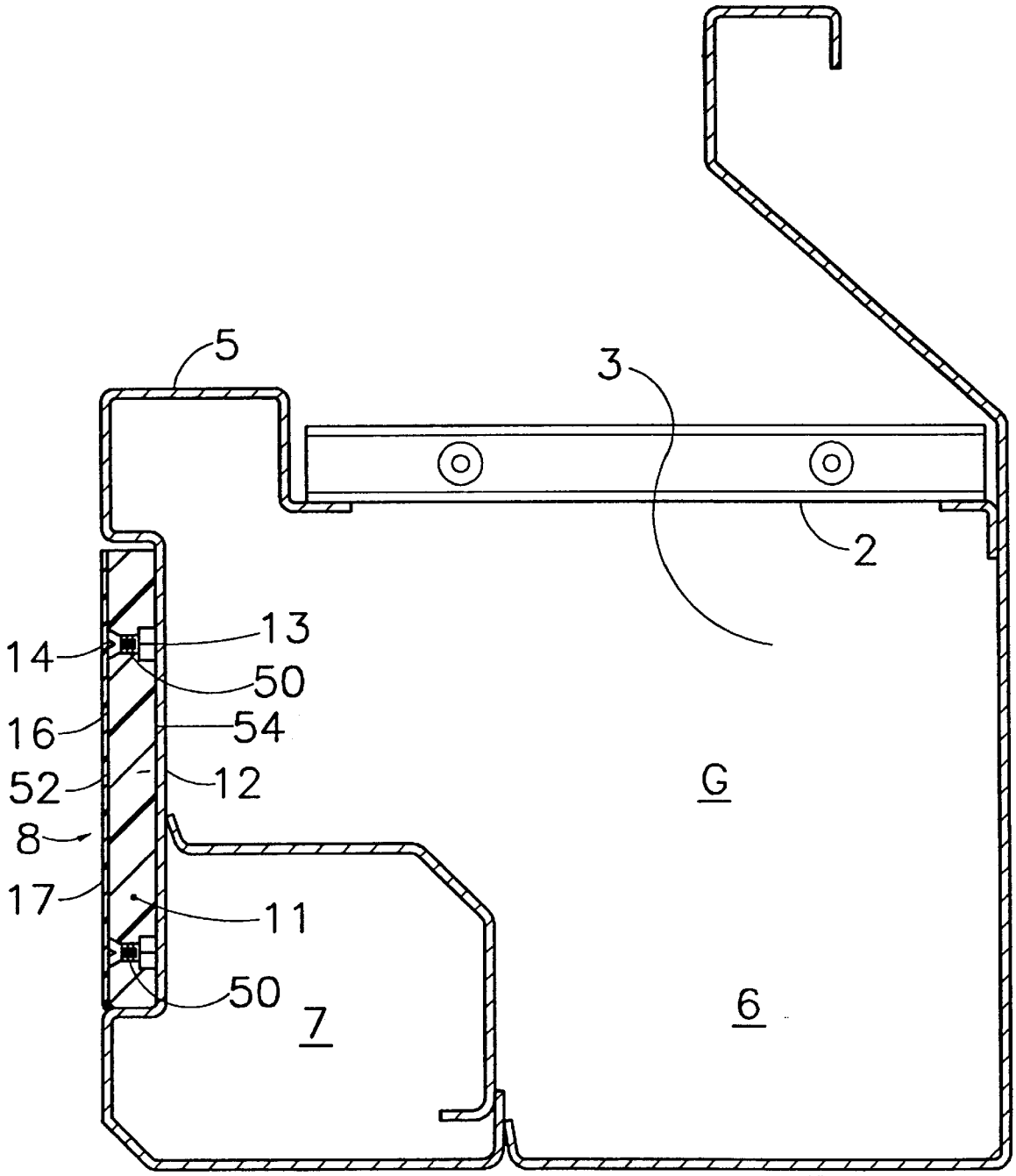
FIG. 4 shows the perimeter skimming gutter of FIG. 1 which incorporates a second preferred embodiment of the wall covering including a plastic non-skid nylon reinforced vinyl sheet applied to the base thereof in lieu of the tile face.

The perimeter skimming gutter of FIG. 4 includes a wall covering 8 including a base 11 formed of a strip of PVC backing and, in lieu of the tile facing as in the facing surface arrangement 8 of FIGS. 1–3, instead includes a plastic non-skid nylon reinforced vinyl sheet 17 applied to the PVC backing strip.

In each of the embodiments of FIGS. 1–4, the facing surface is attached to the base of the wall covering independent of the attachment of the base of the wall covering to the gutter wall. In each of the preferred embodiments shown in FIGS. 1–4, the facing surface is adhered to the base.

Figure 5:
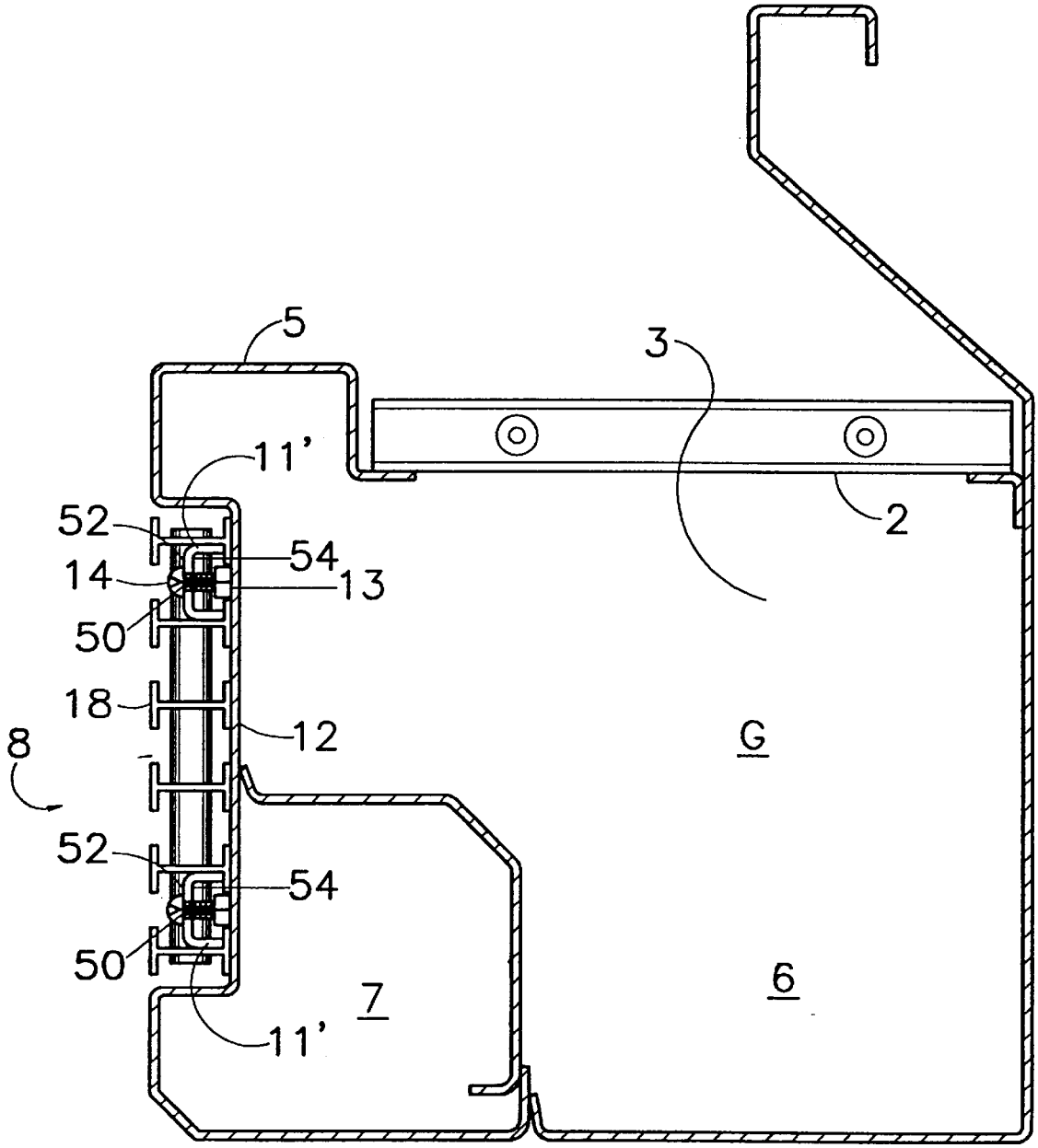
FIG. 5 shows the perimeter skimming gutter of FIG. 1 which incorporates a third preferred embodiment of the wall covering including a facing surface comprising a PVC gutter bar grating.

The perimeter skimming gutter of FIG. 5 includes a wall covering 8 that has a PVC gutter bar grating 18 as the facing surface in lieu of the tile facing. Another difference is that the PVC gutter bar grating 18 does not require a base 11 embodied as a back support as shown in FIGS. 1–3, but rather directly abuts the gutter wall and is retained by a base 11' comprising a mounting plate having a U-shaped cross-section as illustrated in FIG. 5. Indeed, as shown in FIG. 5, the base 11' is affixed to the PVC gutter bar grating 18 by the bolt 14 with a portion of the PVC gutter bar grating 18 extending between and being sandwiched by the base 11' and the gutter wall. Moreover, the PVC gutter bar grating 18 represents a non-skid surface and is just as easily removable from the gutter wall 12 as the wall covering 8 incorporating the tile facing 17.

Any desired facing material can be used as the facing surface in the wall covering of the present invention, including not only ceramic and plastic tile but also other water-resistant material, such as resilient plastic material, for example, plastic foam blocks. If the facing surface is non-self-supporting on the gutter wall like tile, a separate base is needed such as a self-supporting plastic or ceramic sheet. If it is self-supporting, like a grating or ribbed, undulating or wavy plastic or ceramic sheet, the facing surface can be directly attached to the gutter wall.

The perimeter skimming gutter walls shown in the drawings are made of stainless steel, but it will, of course, be understood that other smooth surfaced metals can be used, such as galvanized iron and steel, and aluminum, as well as anodized aluminum. Whatever the metallic material, its surface should be treated so as to render it corrosion-resistant, as by plating, galvanizing, anodizing, porcelain-enamel coating, or painting. It is also possible to form the perimeter skimming gutter of smooth plastic material, either in whole or part. There are plastics now available which are sufficiently strong to withstand the wear and tear of a perimeter gutter system, including, for example, acrylonitrile-butadiene-styrene resin, polycarbonate resin, polytetrafluoroethylene, polyvinyl chloride, polyvinylidene chloride, polyesters, polypropylene, polyamides, and synthetic rubbers such as polyisoprene, polybutadiene, butadiene-styrene copolymers, and butadiene-isoprene copolymers.

The preferred gutter construction is from a sheet or several sheets of metallic or plastic material which are formed into the desired configuration. It is usually preferred that the coping portion at the top rear of the perimeter gutter extend at least partially, and preferably wholly, across an open gutter trough, so as to prevent people from stepping or falling into the gutter. Such can also be prevented by covering the gutter with a grating or grid of metal or plastic, the same as, or different material from, the gutter.

The use of modular units is preferred, because this permits mass production of the gutter system at a point remote from the swimming pool, with easy and inexpensive transportation from that point to swimming pool construction sites anywhere in the world. The modular units can then be assembled on-site to form any type of configuration of swimming pool. The modular units can be made in straight sections for rectangular or other curved-sided pool shapes, while curved sections can be made for pear-shaped, elliptical, circular, or other round-sided pool configurations.

The modular units can be fitted together by welding, soldering or brazing, in the case of metal units, by bonding, using various types of adhesives, in the case of metal or plastic units; or by heat-sealing, ultrasonic welding, or heat-bonding in the case of thermoplastic plastic units. Plastic units which are not fully heat-cured can be bonded and then cured in situ to form a permanent bond on site, in the course of construction of the pool.

The perimeter wall covering can be used partly or completely around the pool perimeter, as desired.

While construction of the gutter in the form of modular units has been described, it will also be appreciated that the gutter wall can be formed on-site in the configurations shown using concrete or plastic material, and can form an integral part of the pool wall, by casting or pouring into suitable frames, so that the material can harden and set in the desired pool shape. The gutter facing surface is sufficiently simple so that this technique can be employed with good results. Since this requires more hand-work, however, and is therefore a more costly method of construction, it would not usually be preferred, particularly in the case of the large pools, where construction costs may be too high to permit the luxury of a hand-made gutter system on the pool site.

The facing surface can be made from bricks or tiles, which are built up in the desired configuration. These can be the usual type of material; preferably with a ceramic facing, so that it is leakproof, with the tiles being bonded together with water-resistant adhesive or cement.

The attaching means can be any conventional attaching means that is accessible and detached readily to remove the wall covering from the gutter wall, such as nuts and bolts, as shown in the drawings; bayonet joints with rotatable pins on the support and bayonet recesses on the gutter; pins with circumferential recesses engaging spring-mounted ball detents on the gutter. Other attaching means will be apparent to those skilled in this art from this description.

The pool-side gutter retaining wall as shown provides two separate conduits, of which either can be used for water feed or gutter flow, as desired. While in the embodiments shown in the drawings the upper is used as a water feed conduit, and the lower a gutter conduit, the upper can serve as a gutter conduit and the lower as a water feed conduit, as in U.S. Pat. Nos. 3,668,712, 3,668,713 and 3,668,714, and No. 4,050, 104.

Moreover, if more than two conduits be desired, additional conduits can be separated out by introducing additional separator walls and intermediate H-wall sections.

In another embodiment found in the retaining wall is a plurality of elongated narrow slots at a level substantially above the bottom of the gutter trough, but only a short distance below the top of the retaining wall.

The level of the drain openings with respect to the bottom of the gutter conduit can be adjustable, so as to provide adjustment of the water level permitted in the gutter before flow via the openings into the second gutter conduit commences. This adjustment can be provided for by forming the openings in the gutter-side retaining wall as vertical slots, or as slots at any angle to the vertical, or as a series of horizontal slots within an extended vertical height, and disposing a movable barrier member over the openings, with the opening or openings of the desired size and shape in the barrier member. Vertical or horizontal movement of the barrier member over the wall openings adjusts the relative open area of the opening or openings in the barrier member that are in register with the openings in the wall. There has to be a fluid-tight seal between the barrier member and the retaining wall, which can be provided for by a gasket or O-ring seal therebetween. The barrier member can move along slots with set screws fixing it at the desired skimmer opening and thus pool level, or by any other conventional means.

The openings can be of any desired size and shape providing a sufficient drain action. Preferably, they are elongated and substantially horizontal, but they can be vertical or at any angle in between. They also should limit flow to prevent surges and waves from entering, and hence are narrow. They should not exceed about one inch in height and should have a length to height ratio of from 1:1 to 100:1, although the latter limit is not critical. The limit is actually imposed only by the feasible length of gutter section and the strength of the material used for the retaining wall.

The swimming pool can be equipped with water filtration and cleaning recirculation systems. The gutters usually feed water therein to such systems by gravity. Pumps can be provided, and the gutters can also be provided with jet water inlets to direct a driving flow or water along the gutters, to flush out the gutters, and to drive water along the gutter towards the water recirculation system. Such jet water inlets are described in U.S. Pat. No. 2,932,397 to Ogden, dated Apr. 12, 1960.

What is claimed is:

1. A perimeter skimming gutter for a swimming pool comprising:

a gutter wall having a planar portion formed of sheet material and including a fastener receiving member integral with and protruding from said planar portion;

a wall covering for attachment to said gutter wall for covering of said gutter wall, said wall covering including a base having an opening extending therethrough between opposite sides thereof and a facing surface attached to said base; and a fastener extending through said opening in said base of said wall covering and received in mating relation by said fastener receiving member of said gutter wall for attachment of said base to said gutter wall, said fastener including a portion engaging said base and urging said base toward said gutter wall whereby said facing surface of said wall covering is retained in covering relation to said gutter wall, the attachment of said facing surface to said base being independent of the attachment of said base to said gutter wall.

2. The perimeter skimming gutter of claim 1, wherein said facing surface is adhered to said base.

3. The perimeter skimming gutter of claim 1, wherein said fastener comprises a bolt and said fastener receiving member comprises a nut.

4. The perimeter skimming gutter of claim 1, wherein said sheet material comprises stainless steel.

5. The perimeter skimming gutter of claim 1, wherein said sheet material comprises plastic.

6. The perimeter skimming gutter of claim 1, wherein said facing surface comprises ceramic tile adhered to said base and said base comprises a back support of said facing surface.

7. The perimeter skimming gutter of claim 1, wherein said facing surface comprises a plastic non-skid nylon reinforced vinyl sheet.

8. The perimeter skimming gutter of claim 1, wherein said base is formed from PVC.

* * * * *